United States Patent [19]

Kiefer

[11] Patent Number: 4,937,949

[45] Date of Patent: Jul. 3, 1990

[54] BASKETBALL COURT LAYOUT DEVICE

[76] Inventor: Jon J. Kiefer, 7010 Mountain Ct., Louisville, Ky. 40219

[21] Appl. No.: 290,511

[22] Filed: Dec. 29, 1988

[51] Int. Cl.[5] ..... B43L 13/20

[52] U.S. Cl. ..... 33/563; 33/1 G

[58] Field of Search ..... 33/1 G, 1 B, 562, 563, 33/565, 566; 101/127; 273/31, 1.5 R, 25

[56] References Cited

U.S. PATENT DOCUMENTS

| | | | |
|---|---|---|---|
| 1,633,163 | 6/1927 | Crouse | 33/565 X |
| 1,974,442 | 9/1934 | Baldwin | 33/565 X |
| 3,889,379 | 6/1975 | Cline | 33/562 |

*Primary Examiner*—Harry N. Haroian

*Attorney, Agent, or Firm*—Edward M. Steutermann

[57] ABSTRACT

Templates for use in the laying out selected features of basketball court with relation to the location of the backboard including a flexible planar elongate sheet of material having a index to locate the backboard in relation to the template with slits provided within the template to outline aspects of a basketball court with relation to the index provided by the backboard and including the freethrow lane, freethrow circle freethrow line as well as other features of a basketball court such as the three point line, baseline, and out of bounds.

4 Claims, 3 Drawing Sheets

BASKETBALL COURT LAYOUT DEVICE

BACKGROUND OF THE INVENTION

The present invention relates in general to templates and more particularly relates to templates for facilitating the layout of a basketball court.

The present extensive use, of basketball goals is well known. The popularity of such devices has been observed for many years and is increasing. However, in addition to the backboard, and in order to simulate actual playing conditions, it is desirable to provide the markings commonly provided on standard basketball court.

Heretofore, no straightforward way has been known to provide such markings; and, in fact, in most instances the proper sizing, spacing, and location of the various markings on a basketball court are so difficult to reproduce that the vast majority of basketball courts do not have such markings.

However, the markings and the locations of the various zones and lines of a fundamental importance in learning the game properly. Instead, a typical court may have a single mark for a freethrow line and in some instances may have out of bounds and base line markings. Seldom are these are in the proper location or properly spaced in relation to each other.

No prior art arrangement is know which teaches the use of templates for marking basketball courts.

The prior art includes U.S. Pat. No. 4,468,862 which teaches a templates for marking the location of football players on a surface for instructional purposes and U.S. Pat. No. 4,573,302 teaches the use of templates in the construction of housing.

U.S. Pat. No. 3,855,924 teaches a method for utilizing a stencil where index marks are provided for location of the stencil with relation with previously stenciled wording.

SUMMARY OF THE INVENTION

The present invention provides a new, useful, inexpensive and straight forward means for marking a basketball court with reference to the location of the backboard and goal where the spacings between the lines, the location of the lines, and the orientation of the lines, can easily be accurately and easily placed.

Devices within the scope of the present invention are easily utilized and require only that the user be able to locate and index on the template with reference to the location of the basketball backboard. The template is then spread over the court and markings are applied to the surface of the court through slits in the template which have been spaced, sized, and located to provide an accurately marked basketball court.

In addition, devices within the scope of the present invention can be easily fabricated by means of a multifold arrangement where the number of cuts required to form the template are greatly minimized and likewise the width of the cutting equipment is substantially reduced.

More particularly, the present invention provides templates for use in the laying out selected features of basketball court with relation to the location of the backboard including a fexible planar elongate sheet of material having a index to locate the backboard in relation to the template with slits provided within the template to outline aspects of a basketball court with relation to the index provided by the backboard and including the freethrow lane, freethrow circle freethrow line and well as other features of a basketball court such as the three point line, baseline, and out of bounds.

Examples of arrangements within the scope of the present invention and methods for making same are illustrated in the accompanying drawings and described hereinafter but it will be understood that the drawings provided herein and methods described hereinafter are merely by way of limitation and that various other methods and apparatus also within the scope of the present invention will occur to those skilled in the art upon reading the disclosure set forth hereinafter.

BRIEF DESCRIPTION OF THE DRAWINGS

Examples within the scope of the present invention are illustrated in the accompanying drawings.

DETAILED DESCRIPTION OF THE DRAWINGS

Figure 1:
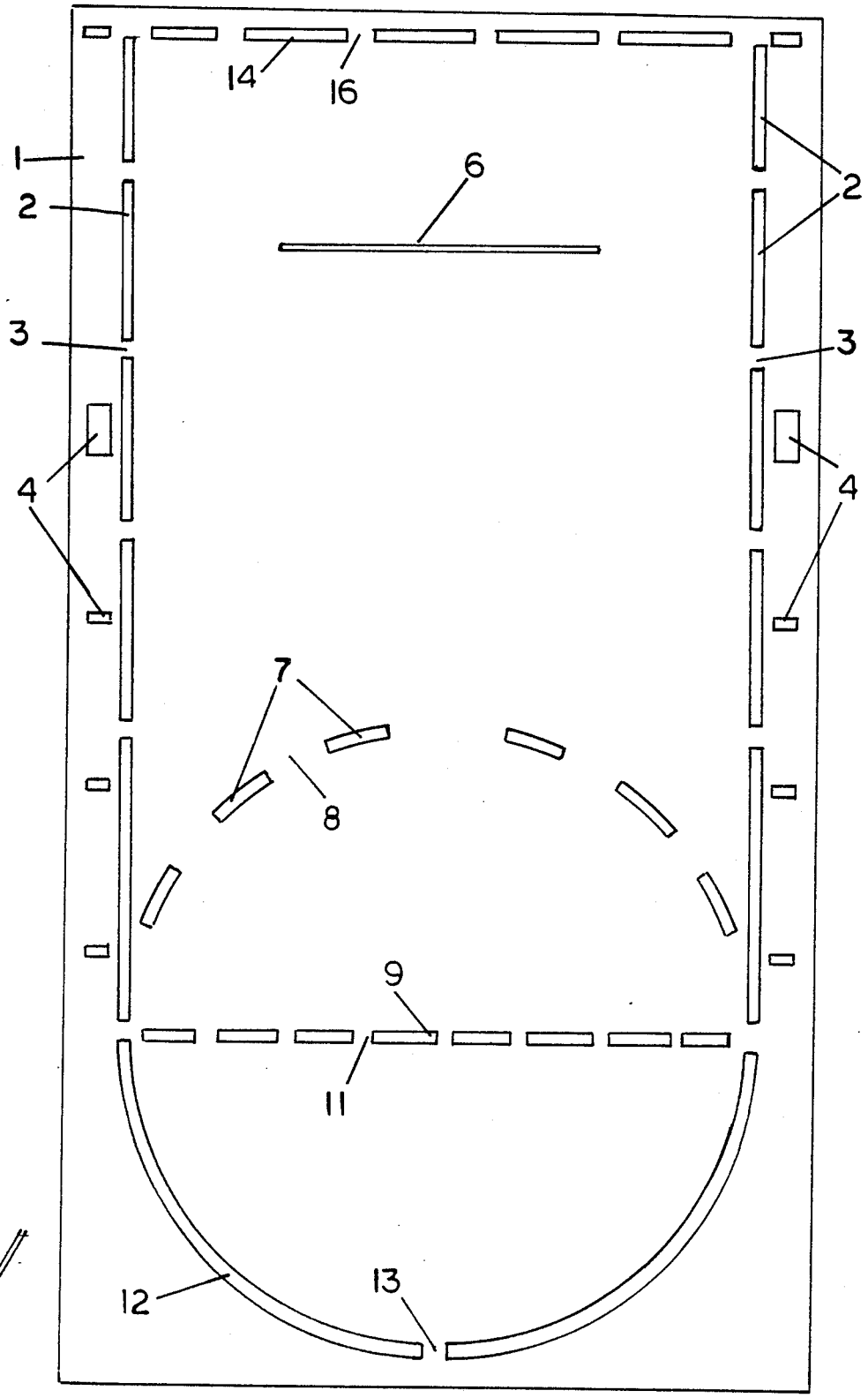
FIG. 1 is a plan view of a template within the scope of the present invention.

Examples within the scope of the present invention are illustrated in the accompanying drawings wherein FIG. 1, shows a template 1, which can typically as shown depicts an outline of the freethrow lane of a basketball court. It will be understood that within the scope of the invention templates provided by the present invention can be of various sizes for the various regulation playing areas, for example high school, college, or in some instances grade school.

Again FIG. 1 depicts a freethrow zone layed out in the desired scale where slits are cut into a planar flexible material one which can, for example, be polyethelene or other suitable plastic or other materials.

In the arrangement shown in FIG. 1 slits 2 have been cut on opposite sides to allow the marking of the sides of the freethrow lane. The player limiting lines 4 have also been show as slits where the freethrow circle is depicted by slits 7 with solid areas 8 between. It will be further noted that with reference to the slits 2 solid areas 3 are provided therebetween. The solid areas are provided of course to hold the template as a unitary structure in order to allow it to be utilized. Likewise the freethrow line is depicted by the slits 9 with solid areas 1 therebetween and top of the freethrow line can be depicted by rather long slits 12 with solid areas 13 therebetween.

Figure 2:
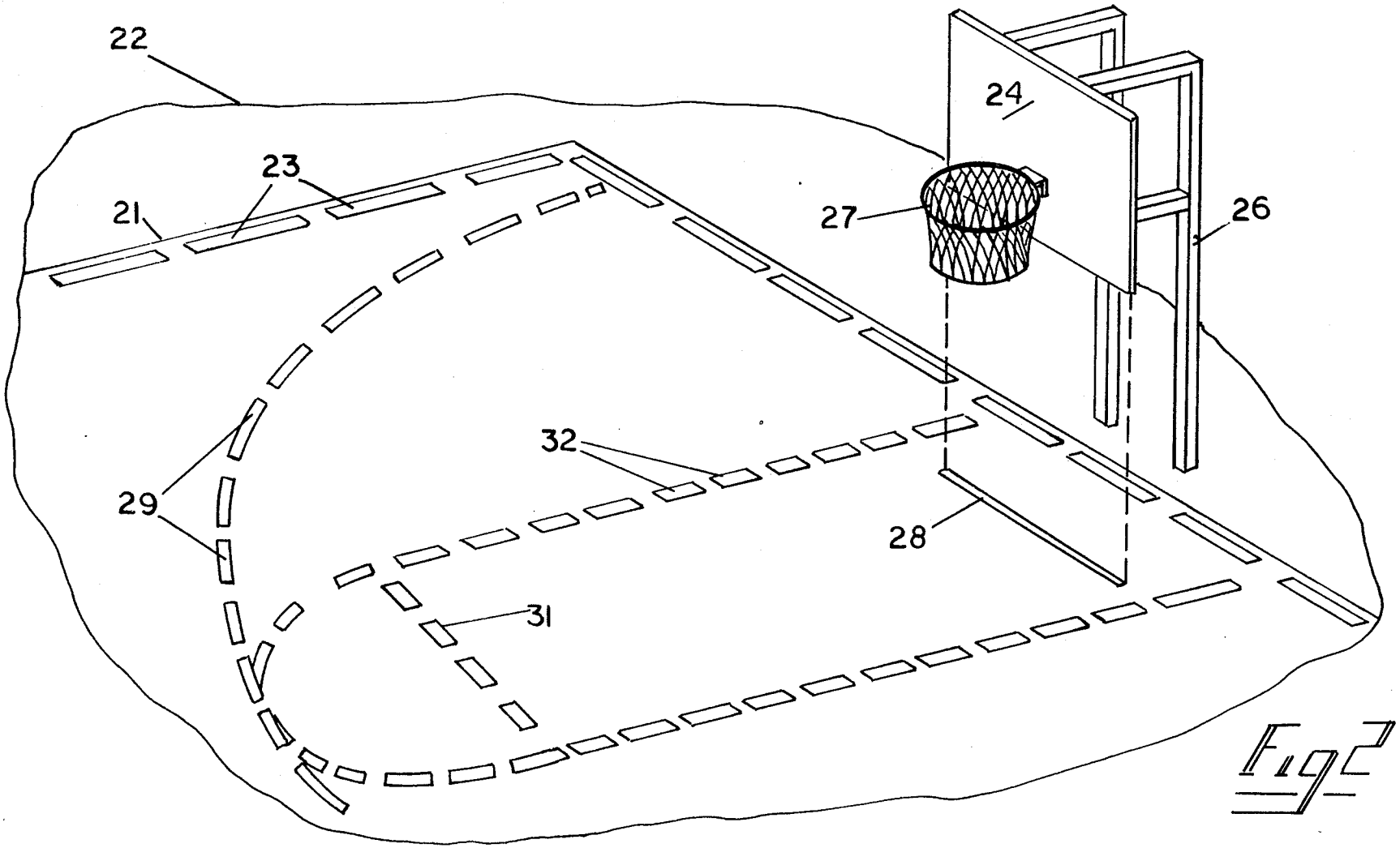
FIG. 2 is a perspective view of a template like that of FIG. 1 in location for use on a typical basketball court.

The device similar to the device shown in FIG. 1 is depicted in FIG. 2 which illustrates the method of use of devices within the scope of the present invention.

A slit 6 is provided which depicts the width of a backboard and the location of the backboard relative to the freethrow circle as depicted. Within the scope of the present invention the slit 6 is utilized for the location and orientation of the template.

In FIG. 2 the side lines 23 are provided as the slits 23 with, as shown in FIG. 1, solid areas therebetween. Also in FIG. 2 the basketball goal 27 is shown attached to a backboard 24 which is supported by a supporting mechanism 26. The backboard 24 is disposed outwardly from the supports 26 and, as shown, the template 21 is located with the alignment slit 28 in alignment with the downward projection of the board 24 for proper orientation of the template.

As also shown the template provides the freethrow lane marking 32 and the freethrow lines 31. In the arrangement shown a larger template is used than shown in FIG. 1 and the three point line 29 is also shown. A base line 30 is likewise shown and while not shown the opposite side line can also be shown along with the full extension of the three point line circle 29.

In use, the Template 21 is located as shown in FIG. 2 and a marking material such as a spray paint or other suitable material is then utilized to mark the playing area through the slits in the template. The template can then be removed and saved for later marking or for marking other areas.

Figure 3:
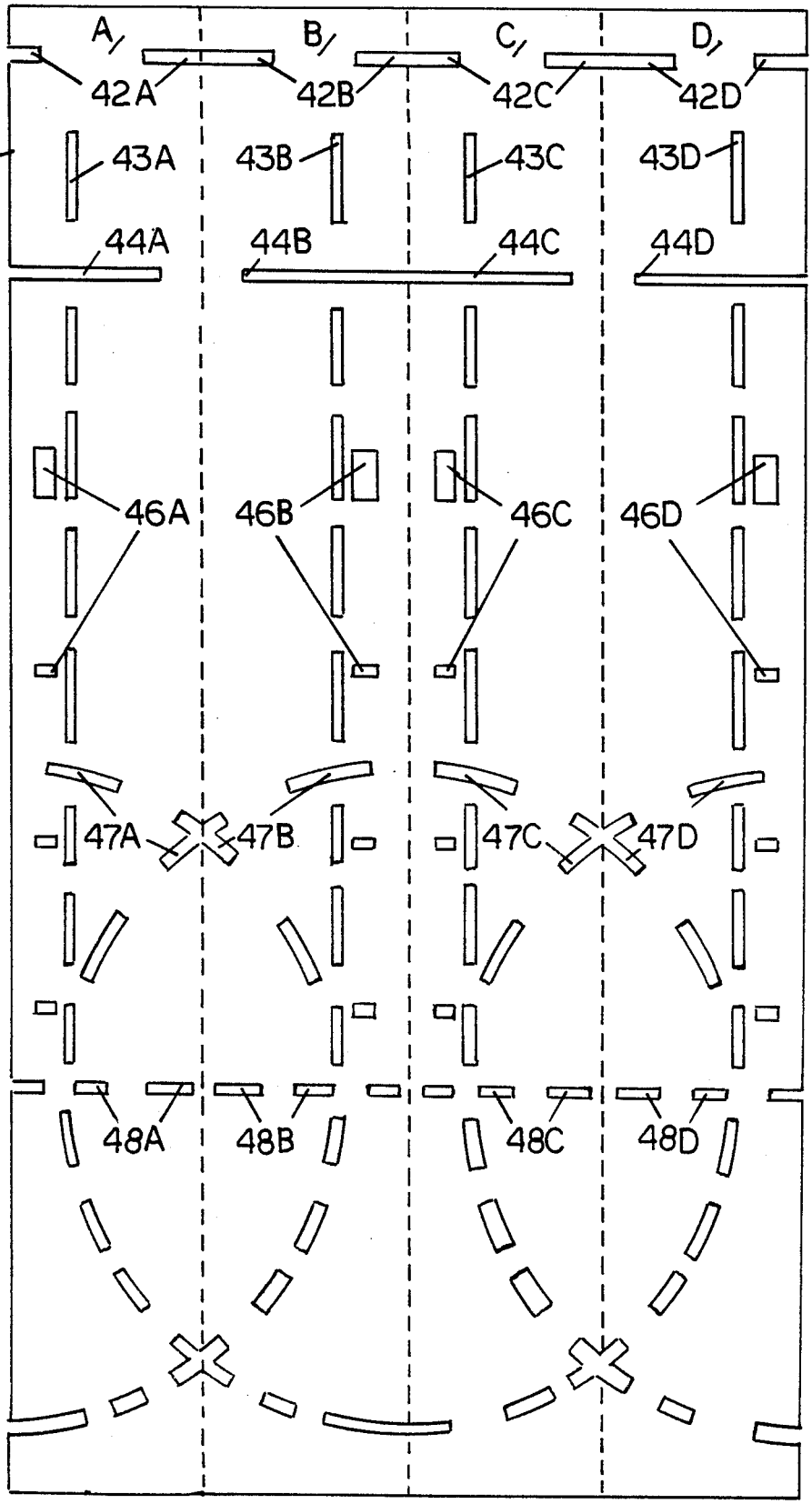
FIG. 3 is a plan view of a template within the scope of the present invention.

FIG. 3 is an illustration of a new and useful method for making for making template of the type shown previously. One problem encountered in connection with the manufacture of the template and particularly large templates is that expensive cutting machinery is required due to the width of the material to be slit. FIG. 3 illustrates an arrangement where a template 41 has been folded into four overlying areas A, B, C, and D for slitting.

Thus, the slitting device need only be ¼ as wide as would be required if the material were to be slit in the nonoverlying orientation. In FIG. 1 the slits 42A, 42B, 42C, and 42D are made at one time through the overlying layers. Likewise the slits 43A, 43B, 43C, 43D, which ultimately defined the freethrow lanes are made simultaneously. When the template is located on the surface to be marked only the slits 43A and 43D are painted. Likewise, the position marking slits 46A, 46B, 46C, and 46D, are cut at one time but the only the areas defined by slits 46A, and 46D are painted. Those noted 46B, and 46C are ignored. In the case of the freethrow lane the slits 48A, 48B, 48C, and 48D are cut at one time with the template in quadruple overlying relation but the outer slits 48A, and 48D are not marked on the playing surface. Likewise it can be seen that the slits 47A, 47B, 47D, define the freethrow circle. Only a portion of the slits which defined the circle are then actually used for marking and the remainder are unpainted.

Again he purpose of the foregoing arrangement is to allow substantial reduction in the cost of production of the devices yet provide an entirely satisfactory template for the purposes intended.

It will be understood that the foregoing are but a few examples within the scope of the present and that various other arrangements also within the scope of the present invention will occur to those skilled in the art upon reading the disclosure set forth hereinbefore.

I claim:

1. Template for use in the laying out selected features of basketball court with relation to the location of the backboard including a fexible planar elongate sheet of material having a index to locate the backboard in relation to the template with slits provided within the template to outline features of a basketball court with relation to the index provided by the backboard and including the freethrow lane, freethrow circle freethrow line where coating means can be applied to the substract on which the template is located.

2. The invention of claim 1 including slits to indicate the location of the bonus shot line.

3. The invention of claim 1 wherein the sheet of material folded upon itself in overlying relation and where said slits are cut through said overlying layers.

4. The invention of claim 3 wherein the sheet material is folded in four layers.

* * * * *